US005334915A

United States Patent [19]

Ohsaki et al.

[11] Patent Number: 5,334,915

[45] Date of Patent: Aug. 2, 1994

[54] OPERATING CIRCUIT ARRANGEMENT FOR A DISCHARGE LAMP

[75] Inventors: Hajime Ohsaki, Hayama; Keiichi Shimizu, Yokohama, both of Japan

[73] Assignee: Toshiba Lighting & Technology Corporation, Tokyo, Japan

[21] Appl. No.: 953,217

[22] Filed: Sep. 30, 1992

[30] Foreign Application Priority Data

Sep. 30, 1991 [JP] Japan ..... 3-252589

[51] Int. Cl.[5] ..... G05F 1/00

[52] U.S. Cl. ..... 315/307; 315/DIG. 7; 315/DIG. 5; 315/200 R; 315/DIG. 4; 315/244; 315/224; 315/205; 315/241 R

[58] Field of Search ..... 315/205, 224, 244, 200 R, 315/241 R, 307, DIG. 4, DIG. 5, DIG. 7

[56] References Cited

U.S. PATENT DOCUMENTS 4,042,856 8/1977 Steigerwald ..... 315/307 X
5,140,224 8/1992 Kakitani et al. ..... 315/DIG. 4 X

FOREIGN PATENT DOCUMENTS 0059064 9/1982 European Pat. Off. .
0439240 7/1991 European Pat. Off. .
2077860 10/1987 Japan .

*Primary Examiner*—Robert J. Pascal
*Assistant Examiner*—Haissa Philogene
*Attorney, Agent, or Firm*—Cushman, Darby & Cushman

[57] ABSTRACT

An operating circuit arrangement for a discharge lamp has a chopper circuit and an inverter circuit. The inverter circuit generates a high frequency voltage to start and operate the discharge lamp. The chopper circuit supplies a d.c. voltage to the inverter circuit. The circuit arrangement has a chopper control circuit and an inverter control circuit which are coupled to the chopper circuit so that the operation of each control circuit responds to the chopper circuit. In order to perform a soft starting operation in which the inverter circuit generates a given high frequency voltage to start and operate the discharge lamp prior to the generation of a given level of d.c. voltage generated by said chopper circuit, an inverter control circuit coupled to the inverter circuit is provided.

19 Claims, 3 Drawing Sheets

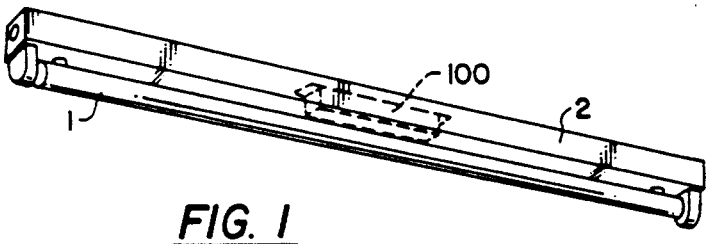
FIG. 1
FIG. 2
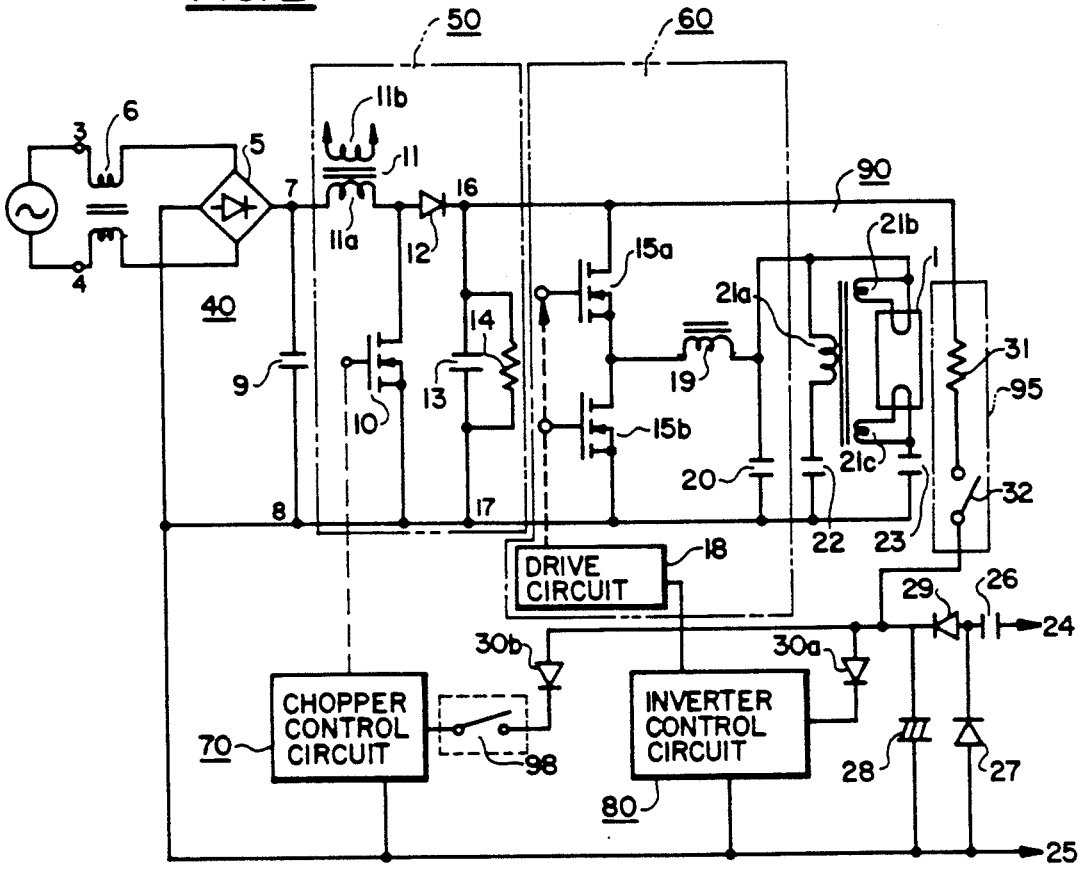

OPERATING CIRCUIT ARRANGEMENT FOR A DISCHARGE LAMP

BACKGROUND OF THE INVENTION

1. Field of the Invention

The present invention relates to an operating circuit arrangement for a discharge lamp. More specifically, the present invention relates to an improved operating circuit arrangement for a fluorescent lamp, which includes at least a chopper circuit and an inverter circuit.

2. Description of the Related Art

An operating circuit arrangement for a discharge lamp formed with a chopper circuit, an inverter circuit and a lighting circuit is well known. The inverter circuit inverts a d.c. voltage to a high frequency voltage and supplies it to the lighting circuit. The d.c. voltage is generated by the chopper circuit where it is then supplied to the inverter circuit. A discharge lamp adapted to the lighting circuit is operated in response to the high frequency voltage. By the operation of the chopper circuit which supplies a substantially constant d.c. voltage to the inverter circuit without lowering the power factor and distorting the output current, the lamp efficiency is increased. The chopper circuit is provided with a chopper control circuit, which controls a driving frequency of a Field Effect Transistor (FET) used as the chopping means in order to generate a given d.c. output voltage. Operation of a separately-excited oscillation type invertor circuit is controlled by an inverter control circuit. Each of the control circuits are provided with specific power source circuits. This is disadvantageous in view of power consumption because the power consumption is continued at the chopper circuit even after the extinction of the discharge lamp. Japanese Patent Disclosure (Kokai) 62-77860 discloses an operating circuit arrangement for a fluorescent lamp, which comprises a chopper circuit, an inverter circuit and a chopper output control circuit. In the Kokai disclosure, an output derived from a secondary winding provided in the inverter circuit is fed to the chopper output control circuit and is regarded as a power source for the chopper output control circuit. However, this output is dependent on the operating condition of the inverter circuit. Namely, the output is not constant. This is disadvantageous for the operating circuit arrangement.

Generally, a conventional inverter circuit is designed to start its operation when the output of the chopper circuit exceeds a given value. As long as the output of the chopper circuit is lower than the given value, the discharge is held in an off-state circuit is regarded as a no-loaded condition. When the operating condition is changed from a no-load condition to a loaded condition, a high output voltage is applied to a switching device of the inverter circuit, which can damage the switching device. This is also disadvantageous for the operating circuit arrangement for the discharge lamp.

SUMMARY OF THE INVENTION

Accordingly, it is an object of the present invention to overcome the above-mentioned disadvantage and provide an improved operating circuit arrangement for a discharge lamp.

To accomplish the above object, there is provided an operating circuit arrangement for a discharge lamp comprising:

An operating circuit arrangement for a discharge lamp comprising:

a rectifier circuit for rectifying an a.c. voltage to a d.c. voltage;

a chopper circuit arrangement coupled to said rectifier circuit, which comprises a chopper circuit for stepping up said d.c. voltage and generating a d.c. output voltage and a chopper control circuit for controlling the operation of said chopper circuit, wherein said chopper control circuit is responsive to said chopper circuit;

an inverter circuit arrangement coupled to said chopper circuit arrangement, which comprises an inverter circuit for generating a high frequency voltage for operating said discharge lamp and an inverter control circuit for controlling the operation of said inverter circuit, wherein said said inverter circuit is led to a given steady operational mode in which said discharge lamp is started and operated prior to the generation of a given level of said d.c. output voltage by said chopper circuit; and a starting circuit coupled to said inverter control circuit and said chopper control circuit for starting both said inverter control circuit and said chopper control circuit.

Other objects and advantages of the present invention will be apparent from the following detailed description of the preferred embodiments taken in conjunction with the accompanying drawings.

BRIEF DESCRIPTION OF THE DRAWINGS

The accompanying drawings illustrate preferred embodiments of the invention.

FIG. 1 shows a fluorescent lamp device utilizing an electric circuit arrangement of the present invention;

FIG. 2 shows a first embodiment of an electric circuit arrangement shown in FIG. 1;

DETAILED DESCRIPTION OF THE PREFERRED EMBODIMENT

Figure 3:
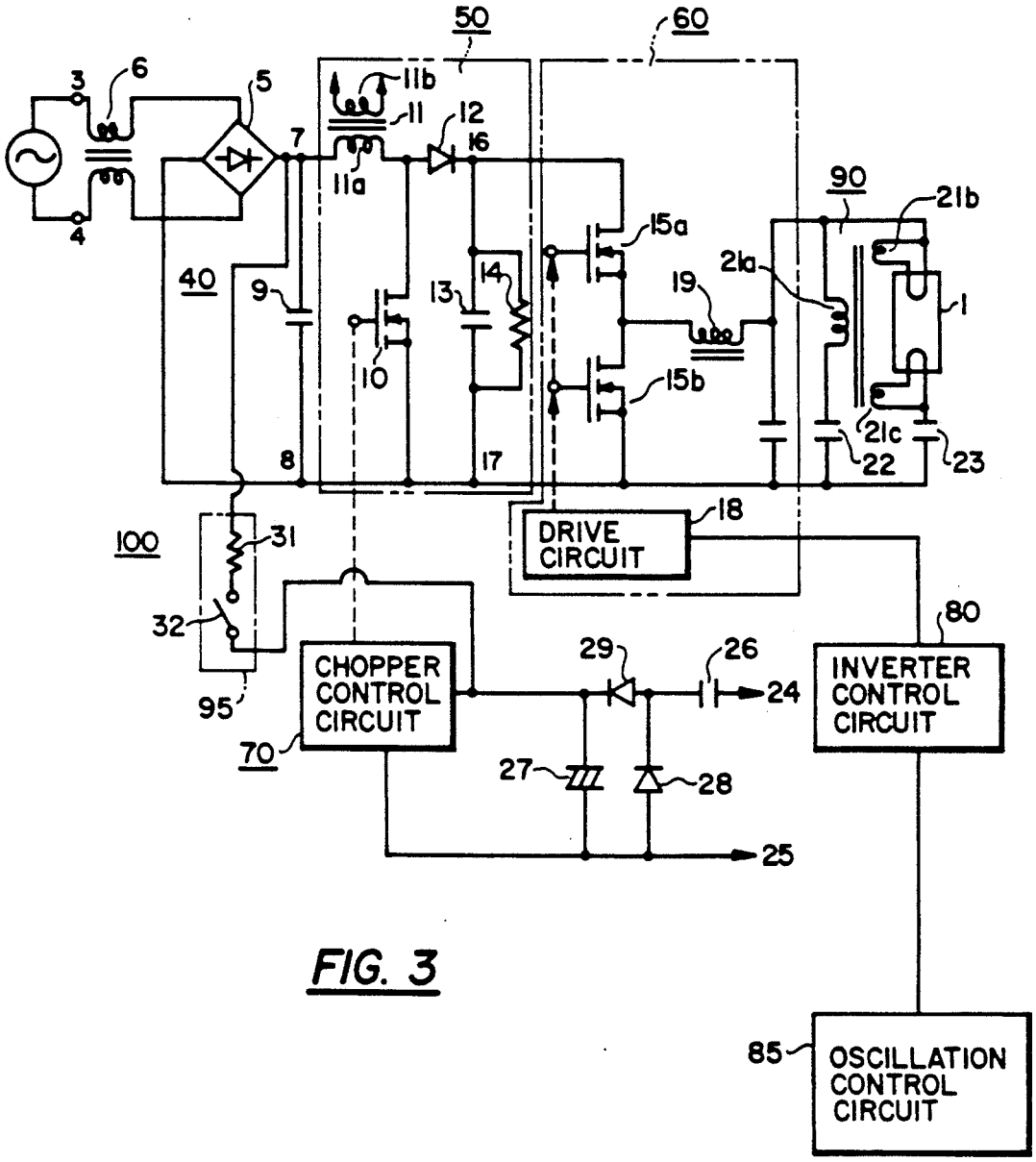
FIG. 3 shows a second embodiment of an electric circuit arrangement according to the present invention.

FIG. 1 shows a fluorescent lamp device. A longitudinal fluorescent lamp 1 is attached to a lamp fixture 2 in which an electric circuit arrangement 100 of the present invention described below is installed.

FIG. 2 shows a first embodiment of electric circuit arrangement 100 of the present invention. Circuit arrangement 100 shown in FIG. 2 is composed of a power supply circuit 40, a chopper circuit 50, an inverter circuit 60, a chopper control circuit 70, an inverter control circuit 80 and a lighting circuit 90.

Reference numerals 3,4 denote input terminals which are intended to be connected to an a.c. voltage, such as 100 volts, 60 Hz. A full-wave rectifier circuit 5 is connected to terminals 3,4 through a transformer 6. Two output terminals 7,8 of rectifier circuit 5 are interconnected to a capacitor 9. An output voltage of power supply circuit 40 is applied to chopper circuit 50. A Field Effect Transistor 10 (hereinafter referred as FET) and a transformer 11 are provided in chopper circuit 50. The drain of FET 10 is connected to one end of a primary winding 11*a* of transformer 11. The other end of primary winding 11*a* is connected to one end of output terminals 7,8 of power supply circuit 40. Numeral 11*b* denotes a secondary winding of transformer 11. A junction point between FET 10 and primary winding 11*a* is connected to a diode 12, A capacitor 13 of which one end is connected to diode 12 is parallel with a resistor 14. The other end of capacitor 13 is connected to the source of FET 10. Namely, the drain of FET 10 is connected to one end of primary winding 11 while the source of FET 10 is connected one end of capacitor 13. An output d.c. voltage of chopper circuit 50 is applied to a separately-excited oscillation type of inverter circuit 60. Inverter circuit 60 provides a pair of Field Effect transistors 15*a*,15*b* as switching means. Output terminals 16,17 of chopper circuit 50 is connected to the drain of FET 15*a* and the source of FET 15*b*, respectively. Each gate of FETs 15*a*,15*b* is driven by a drive circuit 18. One end of a transformer 19 is connected to a capacitor 20 while the other end is connected to the source of FET 15*a* (and the drain of FET 15*b*). An a.c. voltage derived between capacitor 20 is the output of inverter circuit 60. The a.c output voltage is applied to a series circuit of a primary winding 21*a* of a transformer 20 and a capacitor 22 of lighting circuit 90. The a.c output voltage is also applied to coiled electrodes of fluorescent lamp 1. Numeral 23 denotes a capacitor connected to one of the electrodes of fluorescent lamp 1. Each of the coiled electrodes is connected to secondary windings 21*b*,21*c* of transformer 21, respectively. Neither the chopper control circuit 70 or inverter control circuit 80 has a separate power source. An a.c. voltage derived from secondary winding 11*b* of transformer 11 is applied to terminals 24,25 for control circuits 70,80. The a.c. voltage is rectified and smoothed to a d.c voltage by a rectifier circuit forming with capacitors 26,27 and diodes 28,29,30. The d.c. voltage thus obtained is applied to inverter control circuit 80 and chopper control circuit 70. Inverter control circuit 70 is connected to drive circuit 18 for adjusting frequency of the a.c. output voltage of inverter circuit 60. Chopper control circuit 70 is connected to the gate of FET 10 for controlling the chopper operation. A starting circuit 95 which is composed of a resistor 31 is connected to inverter control circuit 80. Starting circuit 95 is connected to chopper circuit so that the d.c. voltage derived at terminals 16,17 is supplied to inverter control circuit 80 therethrough. Starting circuit 95 may provide a switch device 32.

Each operating principle of chopper circuit 50 and inverter circuit 60 is conventional, however, the inverter circuit 60 as shown in this embodiment is so started that fluorescent lamp 1 is operating even before chopper circuit 50 starts the chopper operation. The output of chopper circuit 50 is applied to starting circuit 95. The d.c. voltage mentioned above is tentatively supplied to inverter control circuit 80 from starting circuit 95. Inverter control circuit 80 begins its operation in response to receiving the d.c. voltage. When chopper circuit 50 is out of the operation, the d.c. voltage applied to starting circuit 95 is equivalent to the output derived at terminals 7,8. The operation of drive circuit 18 connected to the gates of FETs 15*a*,15*b* is controlled by inverter control circuit 30. As such, the inverter circuit 60 can start its operation in advance to the operation of chopper circuit 50 by receiving a low level input voltage supplied from the rectifier circuit comprised of capacitors 26,27 and diodes 28,29,30. This method of starting is often referred to as soft starting.

To ensure the soft starting of inverter circuit 60, if necessary, another switch device 98 is provided as indicated by dotted line in FIG. 2. No voltage is applied to chopper control circuit 70 unless switch device 98 is held in the closed position, so that the operation of chopper control circuit 70 is delayed until the time where inverter circuit 60 goes in a steady operating state.

Inverter circuit 60 generates a high frequency voltage, which leads to fluorescent lamp 1 to be operated. Chopper control circuit 50 is also started in response to receiving the d.c. voltage from starting circuit 95. The gate of FET 10 is driven by chopper control circuit 70. Chopper circuit 50 is thus started and generates a predetermined d.c. voltage, for example 410 volts. Accordingly, chopper circuit 50 is started when inverter circuit 60 goes into a steady operation so as to increase the light output of fluorescent lamp 1. When lamp current flowing in lighting circuit 90 becomes larger than a predetermined value, the operation of inverter circuit 60 determined to being steady mode. Although a detailed lamp current detector is not shown, it will be easily obtained by detecting current flowing through lighting circuit 90. In response to the steady mode, switch device 32 of starting circuit 95 is opened. No voltage is applied to both inverter control circuit 80 and chopper control circuit 70 through starting circuit 95. Instead, the output derived from secondary winding 11*b* of transformer 11 is supplied to both control circuits 70,80 through the rectifier circuit. The output voltage derived from transformer 11 of chopper circuit 50 is less dependent on the operating condition of inverter circuit 60 so that the output voltage is relatively constant. This is the main advantage of this embodiment. Opening of switch device 32 prevents starting circuit 95 from consuming power at resistor 31, however such switch device 32 may be eliminated.

Figure 4:
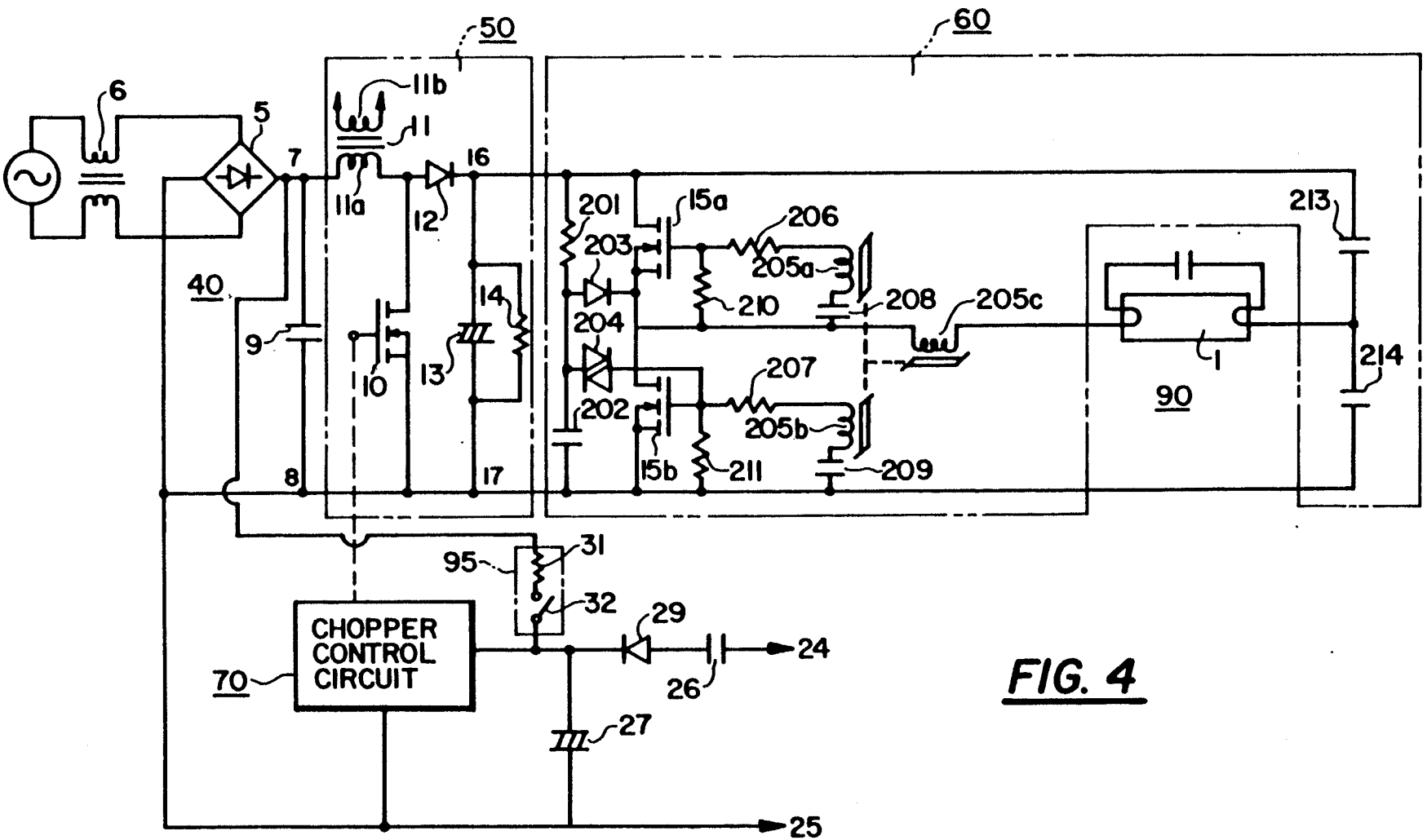
FIG. 4 shows a third embodiment of an electric circuit arrangement according to the present invention.

Another embodiments in accordance with the present invention is shown in FIG. 3 and FIG. 4 and explained hereafter where like reference characters designate identical or corresponding elements of the above-mentioned first embodiment.

FIG. 3 shows a third embodiment of a circuit arrangement according to the present invention, which is regarded as a modification of the circuit arrangement shown in Fig. 2. In this modification an output voltage derived from a secondary winding 11*b* of a transformer 11 in a chopper circuit is supplied only to a chopper control circuit 70 through a rectifier circuit. An inverter control circuit 80 shown in FIG. 3 is equipped with a separate d.c. power source (not shown), which is regarded as a starting circuit corresponding to starting circuit 95 shown in FIG. 2. A chopper control circuit 70 is connected to a starting circuit 95. An oscillation control circuit 85 which is connected to inverter control circuit 80 is designed to respond to the lamp current flowing through lighting circuit 90 and is externally operated. The oscillation control circuit 85 generates a signal to stop the operation of inverter control circuit 80 when fluorescent lamp 1 is extinguished or a stop signal is externally applied thereto. Accordingly, the operation of inverter circuit 60 is stopped when discharge lamp is extinguished.

Fig. 4 shows a third embodiment of a circuit arrangement according to the present invention. A series circuit of a resistor 201 and a capacitor 202 is interconnected to the output terminals 16,17 of a chopper circuit 50. A diode 203 and a bidirectional diode-thyristor 204 are interposed between a junction point of the series circuit and the source of a FET 15*a* (and the drain of a FET 15*b*). An inverter circuit 60, which is considered a self-excited type of inverter circuit, is provided with a saturatable transformer 205 having a pair of input windings 205*a*,205*b*. The gates of FETs are connected to resistors 206,207, respectively. One end of each input windings 205*a*,205*b* is connected to resistors 206,207, respectively while the each other ends are connected to capacitors 208,209, respectively. Each gate and source of FETs 15*a*,15*b* is interconnected by resistors 210,211, respectively. An output winding 205*c* of transformer 205 is interposed between a fluorescent lamp 1 and the source of FET 15*a* (the drain of FET 15*b*). A series circuit of shunt capacitors 213,214 is interconnected between output terminals 16,17. Unlike the other embodiments described above, the circuit arrangement shown in FIG. 4 has two starting circuits. One of the starting circuit is connected to a chopper control circuit 70 and is denoted by numeral 95. The other is formed with resistor 201, capacitor 202 and bidirectional diode-thyristor 204. An inverter control circuit in this embodiment is formed with resistors 206,207,210,211, capacitors 208,209 and output winding 205 of transformer 205. Inverter circuit 60 is capable of starting with a relatively small input voltage, so that a soft starting is achieved.

Many changes and modifications in the above described embodiments can be carried out without departing from the scope of the present invention. That scope is intended to be limited only by the scope of the appended claims.

What is claimed is:

1. An operating circuit arrangement for a discharge lamp comprising:

a rectifier circuit for rectifying an a.c. voltage to a d.c. voltage;

a chopper circuit arrangement, coupled to said rectifier circuit, which comprises;

a chopper circuit for stepping up said d.c. voltage and generating a d.c. output voltage, and a chopper control circuit for controlling the operation of said chopper circuit, wherein said chopper control circuit is responsive to an output of said chopper circuit;

an inverter circuit arrangement, coupled to said chopper circuit arrangement, which comprises:

an inverter circuit for generating a high frequency voltage for operating said discharge lamp, and an inverter control circuit for controlling the operation of said inverter circuit in a manner such that said inverter circuit is placed in a steady operational mode in which said discharge lamp is activated prior to the generation of a given level of said d.c. output voltage by said chopper circuit; and a starting circuit, coupled to said inverter control circuit and said chopper control circuit, for starting both said inverter control circuit and said chopper control circuit.

2. An operating circuit arrangement as claimed in claim 1, wherein said said inverter control circuit is also responsive to an output of said chopper circuit.

3. An operating circuit arrangement as claimed in claim 2, wherein said chopper circuit arrangement further comprises delay means coupled to said starting circuit for delaying the operation of said chopper control circuit by an amount of time required by said inverter circuit to reach said steady operational mode.

4. An operating circuit arrangement as claimed in claim 1, wherein said starting circuit comprises a series circuit of a resistor and a switching element, wherein said switching element is opened after said inverter circuit reaches said steady operational mode, so that said series circuit is disconnected from said chopper control circuit.

5. An operating circuit arrangement as claimed in claim 2, wherein said starting circuit comprises a series circuit of a resistor and a switching element, wherein said switching element is opened after said inverter circuit reaches said steady operational mode, so that said series circuit is disconnected from said chopper control circuit.

6. An operating circuit arrangement as claimed in claim 3, wherein said starting circuit further comprises a series circuit of a resistor and a switching element, wherein said switching element is opened after said inverter circuit reaches said steady operational mode, so that said series circuit is disconnected from said inverter control circuit.

7. An operating circuit arrangement as claimed in claim 4, wherein said chopper circuit comprises a transformer having a first winding and a second winding, said second winding being coupled to said chopper control circuit in order to utilize an a.c. voltage derived from said chopper circuit as a source for said chopper control circuit whereby said chopper control circuit is responsive to the operation of said chopper circuit.

8. An operating circuit arrangement as claimed in claim 5, wherein said chopper circuit comprises a transformer having a first winding and a second winding, wherein said second winding is coupled to said chopper control circuit and said inverter control circuit in order to utilize an a.c. voltage derived from said chopper circuit as a source for said chopper control circuit and inverter control circuit, whereby said chopper control circuit and said inverter control circuit are responsive to the operation of said chopper circuit.

9. An operating circuit arrangement as claimed in claim 6, wherein said chopper circuit comprises a transformer having a first winding and a second winding, wherein said second winding is coupled to said chopper control circuit and said inverter control circuit in order to utilize an a.c. voltage derived from said chopper circuit as a source for said chopper control circuit and inverter control circuit, whereby said chopper control circuit and said inverter control circuit are responsive to the operation of said chopper circuit.

10. An operating circuit arrangement for a discharge lamp comprising:

a rectifier circuit for rectifying an a.c. voltage to a d.c. voltage;

a chopper circuit arrangement, coupled to said rectifier circuit, which comprises:

a chopper circuit for stepping up said d.c. voltage and generating a d.c. output voltage, and a chopper control circuit for controlling the operation of said chopper circuit, wherein said chopper control circuit is responsive to an output of said chopper circuit;

an inverter circuit arrangement, coupled to said chopper circuit arrangement, which comprises:

an inverter circuit for generating a high frequency voltage for operating said discharge lamp, and an inverter control circuit for controlling the operation of said inverter circuit, wherein said inverter control circuit includes means for starting the operation of said inverter circuit; and a starting circuit coupled to said chopper control circuit for starting said chopper control circuit.

11. An operating circuit arrangement as claimed in claim 10, wherein said starting circuit comprises a series circuit of a resistor and a switching element, wherein said switching element is opened after said inverter circuit reaches said steady operational mode, so that said series circuit is disconnected to said chopper control circuit.

12. An operating circuit arrangement as claimed in claim 11, wherein said chopper circuit comprises a transformer having a first winding and a second winding, wherein said second winding is coupled to said chopper control circuit in order to utilize an a.c. voltage derived from said chopper circuit as a source for said chopper control circuit, whereby said chopper control circuit is responsive to the operation of said chopper circuit.

13. A device for lighting a discharge lamp, comprising:

a lamp fixture for holding said discharge lamp; and an operating circuit arrangement attached to said lamp fixture, said operating circuit arrangement comprising:

(a) a rectifier circuit for rectifying an a.c. voltage to a d.c. voltage, (b) a chopper circuit arrangement coupled to said rectifier circuit, which comprises:

a chopper circuit for stepping up said d.c. voltage and generating a d.c. output voltage, and a chopper control circuit for controlling the operation of said chopper circuit, wherein said chopper control circuit is responsive to said chopper circuit;

(c) an inverter circuit arrangement, coupled to said chopper circuit arrangement, which comprises:

an inverter circuit for generating a high frequency voltage for operating said discharge lamp, and an inverter control circuit for controlling the operation of said inverter circuit, wherein said inverter circuit is placed in a steady operational mode in which said discharge lamp is activated prior to the generation of a given level of said d.c. output voltage by said chopper circuit; and (d) a starting circuit coupled to said inverter control circuit and said chopper control circuit for starting both said inverter control circuit and said chopper control circuit.

14. A device as claimed claim 13, wherein said said inverter control circuit is also responsive to an output of said chopper circuit.

15. A device as claimed in claim 14, wherein said chopper circuit arrangement further comprises delay means coupled to said starting circuit for delaying the operation of said chopper control circuit by an amount of time required by said inverter circuit to reach said steady operational mode.

16. A device as claimed in claim 15, wherein said starting circuit comprises a series circuit of a resistor and a switching element, wherein said switching element is opened after said inverter circuit reaches said steady operational mode, so that said series circuit is disconnected to said chopper control circuit, and wherein said chopper circuit comprises a transformer having a first winding and a second winding, said second winding being coupled to said chopper control circuit in order to utilize an a.c. voltage derived from said chopper circuit as a source for said chopper control circuit, whereby said chopper control circuit is responsive to the operation of said chopper circuit.

17. A device as claimed in claim 13, wherein said starting circuit comprises a series circuit of a resistor and a switching element, said switching element being opened after said inverter circuit reaches said steady operational mode so that said series circuit is disconnected from said chopper control circuit, and wherein said chopper circuit comprises a transformer having a first winding and a second winding, said second winding coupled to said chopper control circuit and said inverter control circuit in order to obtain an a.c. voltage derived from said chopper circuit as a source for said chopper control circuit and inverter control circuit, whereby said chopper control circuit and said inverter control circuit are responsive to the operation of said chopper circuit.

18. A device for lighting a discharge lamp, comprising:

a lamp fixture for holding said discharge lamp; and an operating circuit arrangement attached to said lamp fixture, said operating circuit arrangement comprising:

(a) a rectifier circuit for rectifying an a.c. voltage to a d.c. voltage, (b) a chopper circuit arrangement, coupled to said rectifier circuit, which comprises:

a chopper circuit for stepping up said d.c. voltage and generating a d.c. output voltage, and a chopper control circuit for controlling the operation of said chopper circuit, wherein said chopper control circuit is responsive to said chopper circuit, (c) an inverter circuit arrangement, coupled to said chopper circuit arrangement, which comprises:

an inverter circuit for generating a high frequency voltage for operating said discharge lamp, and an inverter control circuit for controlling the operation of said inverter circuit, said inverter control circuit, said inverter control circuit including means for starting the operation of said inverter circuit; and (d) a starting circuit, coupled to said chopper control circuit, for starting said chopper control circuit.

19. A device as claimed in claim 18, wherein said starting circuit comprises a series circuit of a resistor and a switching element, wherein said switching element is opened after said inverter circuit reaches said steady operational mode, so that said series circuit is disconnected from said chopper control circuit, and wherein said chopper circuit comprises a transformer having a first winding and a second winding, said second winding being coupled to said chopper control circuit in order to utilize an a.c. voltage derived from said chopper circuit as a source for said chopper control circuit, whereby said chopper control circuit is responsive to the operation of said chopper circuit.

* * * * *